US008534023B2

(12) United States Patent
Zhu et al.

(10) Patent No.: US 8,534,023 B2
(45) Date of Patent: Sep. 17, 2013

(54) SELF LOCKING FLOORING PANELS AND RELATED METHODS

(71) Applicants: Shoulian Joseph Zhu, Jacksonville, FL (US); Chi Wang Cheung, Jacksonville, FL (US)

(72) Inventors: Shoulian Joseph Zhu, Jacksonville, FL (US); Chi Wang Cheung, Jacksonville, FL (US)

(73) Assignee: Sunstate Import/Export, Inc. FL (US)

( * ) Notice: Subject to any disclaimer, the term of this patent is extended or adjusted under 35 U.S.C. 154(b) by 0 days.

(21) Appl. No.: 13/654,679

(22) Filed: Oct. 18, 2012

(65) Prior Publication Data

US 2013/0042567 A1 Feb. 21, 2013

Related U.S. Application Data

(63) Continuation of application No. 13/022,948, filed on Feb. 8, 2011, now abandoned.

(51) Int. Cl.
*E04B 2/00* (2006.01)

(52) U.S. Cl.
USPC ..... 52/588.1

(58) Field of Classification Search
USPC ..... 52/588.1
See application file for complete search history.

(56) References Cited

U.S. PATENT DOCUMENTS

| | | | | |
|---|---|---|---|---|
| 1,978,075 | A | 10/1934 | Butterworth | |
| 2,914,815 | A | 12/1959 | Alexander | |
| 3,538,819 | A | 11/1970 | Gould | |
| 3,554,850 | A | 1/1971 | Kuhle | |
| 3,731,455 | A | 5/1973 | Theurer | |
| 3,914,913 | A | 10/1975 | Roberts | |
| 4,845,907 | A | 7/1989 | Meek | |
| 5,050,362 | A | 9/1991 | Tal et al. | |
| 5,052,158 | A | 10/1991 | D'Luzansky | |
| 5,179,812 | A | 1/1993 | Hill | |
| 5,797,237 | A | 8/1998 | Finkell, Jr. | |
| 6,820,386 | B2 | 11/2004 | Kappeli et al. | |
| 7,155,871 | B1 | 1/2007 | Stone et al. | |
| 7,591,116 | B2 | 9/2009 | Thiers et al. | |
| 7,856,785 | B2 | 12/2010 | Pervan | |
| 8,006,460 | B2 * | 8/2011 | Chen et al. | 52/592.1 |
| 2003/0093964 | A1 * | 5/2003 | Bushey et al. | 52/592.1 |
| 2005/0166513 | A1 * | 8/2005 | Vanderhoef | 52/578 |
| 2007/0175137 | A1 | 8/2007 | Stone et al. | |
| 2008/0141611 | A1 | 6/2008 | Chen et al. | |
| 2008/0184647 | A1 | 8/2008 | Yau | |
| 2009/0031662 | A1 | 2/2009 | Chen et al. | |
| 2009/0064623 | A1 | 3/2009 | Lee | |
| 2009/0183458 | A1 | 7/2009 | Gibson et al. | |

FOREIGN PATENT DOCUMENTS

| | | |
|---|---|---|
| GB | 812617 | 4/1959 |

* cited by examiner

*Primary Examiner* — Mark Wendell
(74) *Attorney, Agent, or Firm* — Allen, Dyer, Doppelt, Milbrath & Gilchrist, P.A.

(57) ABSTRACT

A floor panel may include a bottom layer and an upper layer overlying the bottom layer. The bottom layer may have first and second edges, and the bottom layer may include at least one male protrusion on the first edge, and have at least one female protrusion receptacle on the second edge corresponding to a shape of the at least one male protrusion. The bottom layer may further include at least one male lip on the second edge, and have at least one female lip receptacle on the first edge corresponding to a shape of the at least one male lip. The upper panel may vertically overly the at least one female lip receptacle and the at least one female protrusion receptacle.

24 Claims, 2 Drawing Sheets

SELF LOCKING FLOORING PANELS AND RELATED METHODS

CROSS-REFERENCE TO RELATED APPLICATIONS

The present application is a continuation of U.S. application Ser. No. 13/022,948 filed Feb. 8, 2011, the entire contents of which are hereby incorporated herein by reference.

FIELD OF THE INVENTION

The present invention relates to flooring materials and, more particularly, to interlocking floor panels.

BACKGROUND OF THE INVENTION

For rigid flooring materials, locking mechanisms have been used for connecting flooring pieces together for over a century. For example, U.S. Pat. No. 1,978,075 to Butterworth describes wood block flooring with a tongue and groove engagement system for securement of such blocks in side-by-side relationship. U.S. Pat. No. 2,914,815 by Alexander shows an interlocking flooring system wherein individual blocks have offset base members formed of plywood. U.S. Pat. No. 3,554,850 to Kuhle shows parquet flooring with projecting parts for side-by-side securement of similar parquet sections. U.S. Pat. No. 3,914,913, issued to Roberts, discloses a snap interlock deck structure of extruded aluminum. U.S. Pat. No. 3,731,455, issued to Hoffmann et al., discloses floor tiles joined together by cutting away material along the edges thereof so as to leave downwardly-extending undercut projections. The tiles are joined together by using a strip having a pair of channels which receive the projections from two different tiles. U.S. Pat. No. 5,179,812, issued to Hill, discloses a wood panel having a plurality of aluminum battens connected to the base of the panel. U.S. Pat. No. 5,052,158, issued to D'Luzansky, discloses a modular locking floor covering having panels with interlocking means composed of spaced locking fingers and locking apertures and secondary locking means in the form of tabs in the face of the finger and the base of the aperture. Each tab has a face inclined in a direction opposite to the inclined face of an adjacent tab.

Another interlocking design is disclosed in U.S. Pat. No. 5,050,362, issued to Tal et al., which discloses construction panels for roofing and the like that become locked to define a connection which is highly resistant to both clockwise and counter-clockwise movements applied about a connection axis. U.S. Pat. No. 3,538,819, issued to Gould, discloses air field matting having interlocking members. Further, U.S. Pat. No. 4,845,907, issued to Meek, discloses interlocking panel modules usable for decking sections in poultry operations.

An example of a mechanism that is commonly used for securing flooring blocks is set forth in U.S. Pat. No. 5,797,237, issued to Finkell, Jr. This reference describes a snap-together flooring system which fixes adjacent flooring members from lateral movement with respect to one another. A first flooring member includes a channel having a downwardly extending barb. A second flooring member includes an outwardly extending tongue having a groove defined therein. The first and second flooring members are snapped together by moving the tongue into the channel, which causes the barb to ride upwardly on an inclined face of the tongue in an elastic manner, and to ultimately snap downwardly into place within the groove of the tongue. The engagement of the barb in the groove of the tongue prevents laterally removal of the tongue from the channel, and thus holds the adjacent flooring members together. Disengagement of the flooring members is provided by lifting of the interface between the adjacent flooring members and rotating the flooring member having the tongue downwardly in order to disengage the barb from the groove of the tongue, and to thus allow extraction of the tongue from the channel. U.S. Pat. No. 7,591,116 to Thiers et al. is for packaging flooring panels that also includes a locking design similar to Finkell's.

U.S. Pat. No. 7,856,785 to Pervan discloses a tongue for both the long side and the short side as well as a locking groove also for both the long and short sides of a panel. The system is for laminate floor panels that have a harder decorative surface layer than the core layer beneath.

With respect to flexible flooring materials, one potential disadvantage of rigid flooring materials is that they do not conform to the contours of the hard floor surface. The mitigating measures could be expensive and complicated to apply. Flexible materials of rubbery or plastic types are then utilized for such applications. British Pat. No. 812,617 discloses flooring having rubber members of rectangular or square shape. Adjacent members are engaged with one another by a snap action through pressure directed perpendicularly to the joint line between the adjacent members. U.S. Pat. No. 7,155,871 describes how two floor panels of two layers of flexible plastic sheet material laminated together in offset relationship to define an offset marginal portion for each of the layers are jointed together. Each of the offset marginal portions has oppositely facing adhesive coated surfaces. A foam layer and/or a fiberglass sheet can also be included in the laminate structure of the floor panel. The floor panel can conform to surface contours of a floor base. The bottom layer of the floor panel, whether it is plastic sheet or foam, is conformable to surface irregularities of the floor base. A one piece releasable packaging device covers the oppositely facing adhesive coated surfaces of the offset marginal portions.

Regarding other interlocking systems, there may be drawbacks associated with flooring locking mechanisms. U.S. Pub. No. 2008/0184647 discusses a fabricated hardwood flooring product which is to provide an advantage of a thick wood wear layer, similar to a traditional ¾-inch solid wood floor, with the dimensional stability characteristics of engineered wood flooring products. An interlocking design has also been set forth in U.S. Pub. No. 2009/0031662, in which a floor panel includes a first sheet having four sides. The first sheet has an upper surface and a lower surface, and the first sheet includes at least one base layer and a print design located above the base layer. At least one wear layer is located above the print design. Furthermore, a second sheet has multiple sides and having an upper surface and a lower surface, and the upper surface of the second sheet is adhered to the lower surface of the first sheet. Two adjacent sides of the second sheet have multiple projections to interlock with recesses from at least one adjacent floor panel, and two other adjacent sides have recesses to interlock with projections from at least one adjacent floor panel. The projections and recesses have a complementary shape to each other to be interlockingly engageable with corresponding recesses or projections on an adjacent floor panel. The multiple projections of the two adjacent sides of the second sheet extend beyond two adjacent sides of the first sheet, and the recesses of the two other adjacent sides of the second sheet do not extend beyond the first sheet and are concealed by the first sheet. At least a portion of the lower surface of the first sheet that is located directly above the recesses have at least one adhesive coating that permits adhesion of an upper surface of a projection from an adjacent floor panel or the upper surfaces of the projections have an adhesive coating or both.

U.S. Pub. No. 2009/0064623 relates to a double-layered floor panel sheet having a non-adhesive portion, and more particularly to a floor panel sheet enabling adjustment of position during installation. When the upper layer of a floor panel sheet is bonded to the lower layer of another floor panel sheet, a non-adhesive portion formed in part of an adhesive portion enables the adjustment of position. An application specifically for bamboo flooring panels with glueless locking system was set forth in U.S. Pub. No. 2008/0141611. This reference provides a 100% bamboo panel with an interlocking system and associated manufacturing methods. In one embodiment, the 100% bamboo panel includes first, second, and third layers of 100% bamboo, wherein the layers are laminated together. The layers are independently preconditioned to control moisture content therein. Each layer can be preconditioned by alternately elevating and lowering the moisture content in a plurality of sequential cycles before the layers are laminated together. The middle layer is oriented so its grain is substantially perpendicular to the edges of the panel. The panel has joinery portions formed along the edges, and joinery includes an asymmetric upper joinery member and lower joinery member arrangement for, and at least a portion of the upper joinery member and lower joinery member portions are formed in the second layer.

U.S. Pub. No. 2009/0183458 describes a paneling system preferably for floors defined by a series of panels each formed of a plurality of tongue and groove main floor panel strips arranged side edge to side edge and cut to a common length with a tongue along one cut edge and a groove along the other. At the edges are attached edge strips formed also from the flooring panels with tongue and groove and fastened together to form a common panel member for transportation and installation. The outwardly facing edge has a tongue or groove for mating with a groove or tongue of an adjacent panel. The strips are fastened by pins or corrugated plates from the rear or by a bonded sheet material on the rear. The strips may include tongue and groove joints of the snap fastening type where the connection of each strip to the next in the assembled panel can be simply by way of an adhesive tape over the rear surface of the joint.

Joining flooring pieces such as those described above may have drawbacks including that they may be difficult to make, and/or they may not be user friendly. In some instances they may not be cost effective in terms of manufacturing and/or installation. There may also be a potential for human error in the installation process. For instance, traditional adhesive systems for vinyl panel installation involve first preparing the floor, then applying adhesive the entire area to be covered, and finally laying the vinyl panels. However, this process may require relatively costly adhesive, and intensive installation labor. One approach intended to address such cost and inefficiency drawbacks is set forth in U.S. Pat. No. 7,155,871. Here, the adhesive is pre-applied by the manufacturer and may be covered with wax paper also. An installer would peel off the paper and put the male side on top of the female side, then push down and glue together.

Even so, this process may require that the installer be very careful when aligning the two pieces together before pressing them down, as gaps may otherwise form between the adjacent panels. When this happens, the already glued together panels have to be separated and realigned to complete the installation process. A significant disadvantage of this is that after the vinyl panels are pulled apart a couple of times, this may make the adhesive lose its original strength, and also make the installation process more frustrating.

SUMMARY OF THE INVENTION

A floor panel may include a bottom layer and an upper layer overlying the bottom layer. The bottom layer may have first and second edges, and the bottom layer may include at least one male protrusion on the first edge, and have at least one female protrusion receptacle on the second edge corresponding to a shape of the at least one male protrusion. The bottom layer may further include at least one male lip on the second edge, and have at least one female lip receptacle on the first edge corresponding to a shape of the at least one male lip. The upper panel may vertically overly the at least one female lip receptacle and the at least one female protrusion receptacle. As such, the panel may provide both vertical and horizontal locking between multiple floor panels.

More particularly, a shape of the at least one male protrusion may be different than a shape of the at least one male lip. The at least one male protrusion and the at least one male lip may have different widths, and the at least one male protrusion and the at least one male lip may also have different lengths. Additionally, the at least one male protrusion may be configured to compress corresponding sidewall portions of a corresponding female protrusion receptacle of an adjacent floor panel upon connection therewith.

The bottom layer may have a thickness associated therewith, and a width of the at least one lip may be less than or equal to one and one-half times the thickness of the bottom layer. Furthermore, the bottom layer may also have third and fourth edges which are perpendicular to the first and second edges, and at least one interlocking end protrusion may be carried on each of the third and fourth edges of each bottom layer. By way of example, the top layer may comprise at least one of wood and plastic.

A related floor panel system may include a plurality of floor panels, such as those discussed briefly above. A related floor panel installation method may include arranging a plurality of floor panels, such as those discussed briefly above, on a floor. The method may further include coupling the floor panels together so that the male protrusions are coupled to corresponding female protrusion receptacles of adjacent floor panels, and so that the male lips are coupled to corresponding female lip receptacles of adjacent floor panels.

DETAILED DESCRIPTION OF THE PREFERRED EMBODIMENTS

Figure 1:
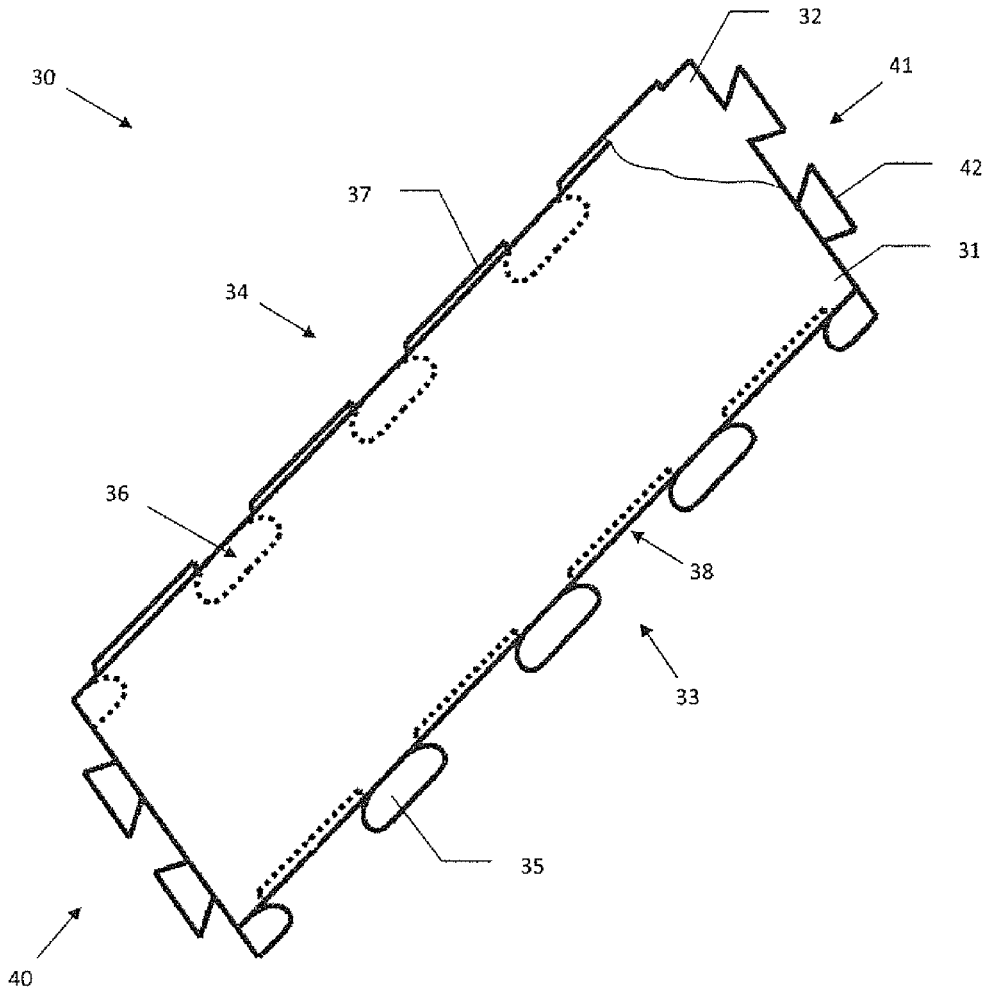
FIG. 1 is a perspective top view of a floor panel in accordance with an example embodiment of the invention shown in partial cutaway.

Referring initially to FIG. 1, a floor panel 30 illustratively includes a top layer 31 attached to a bottom layer or substrate 32. The bottom layer 32 has respective first and second edges or sides 33, 34, and the bottom layer 32 illustratively includes male protrusions 35 on the first edge, and female protrusion receptacles 36 on the second edge corresponding to a shape of the male protrusions. The bottom layer 32 further illustratively includes male lips 37 on the second edge 34, and female lip receptacles 38 on the first edge 33 corresponding to a shape of the male lips. The upper panel 31 vertically overlies the female lip receptacles 38 and the female protrusion receptacles 36. As such, both vertical and horizontal locking may be provided between multiple floor panels 30.

More particularly, the male lips 37 on the second edge 34 provide vertical locking for the floor panels 30 when inserted into the female lip receptacles 38 on the first edge 33 of a neighboring or adjacent panel. A width of the male lips 37 may be related to a thickness and rigidity of the substrate. For example, the width of the male lips 37 may be less than or equal to one and one-half times a thickness of the bottom layer 32. In some embodiments the male lips 37 and the female lip receptacles 38 may be formed by offsetting the top layer 31 relative to the bottom layer 32. The male protrusions 35/female protrusion receptacles 36 and the male lips 37/female lip receptacles 38 may conceptually be considered as mirror images of one another with respect to their center lines.

In the illustrated example, the bottom layer 32 also has third and fourth edges 40, 41 which are perpendicular to the first and second edges 33, 34. Interlocking end protrusions 42 are carried on each of the third and fourth edges 40, 41 of the bottom layer 32 as shown.

Figure 2:
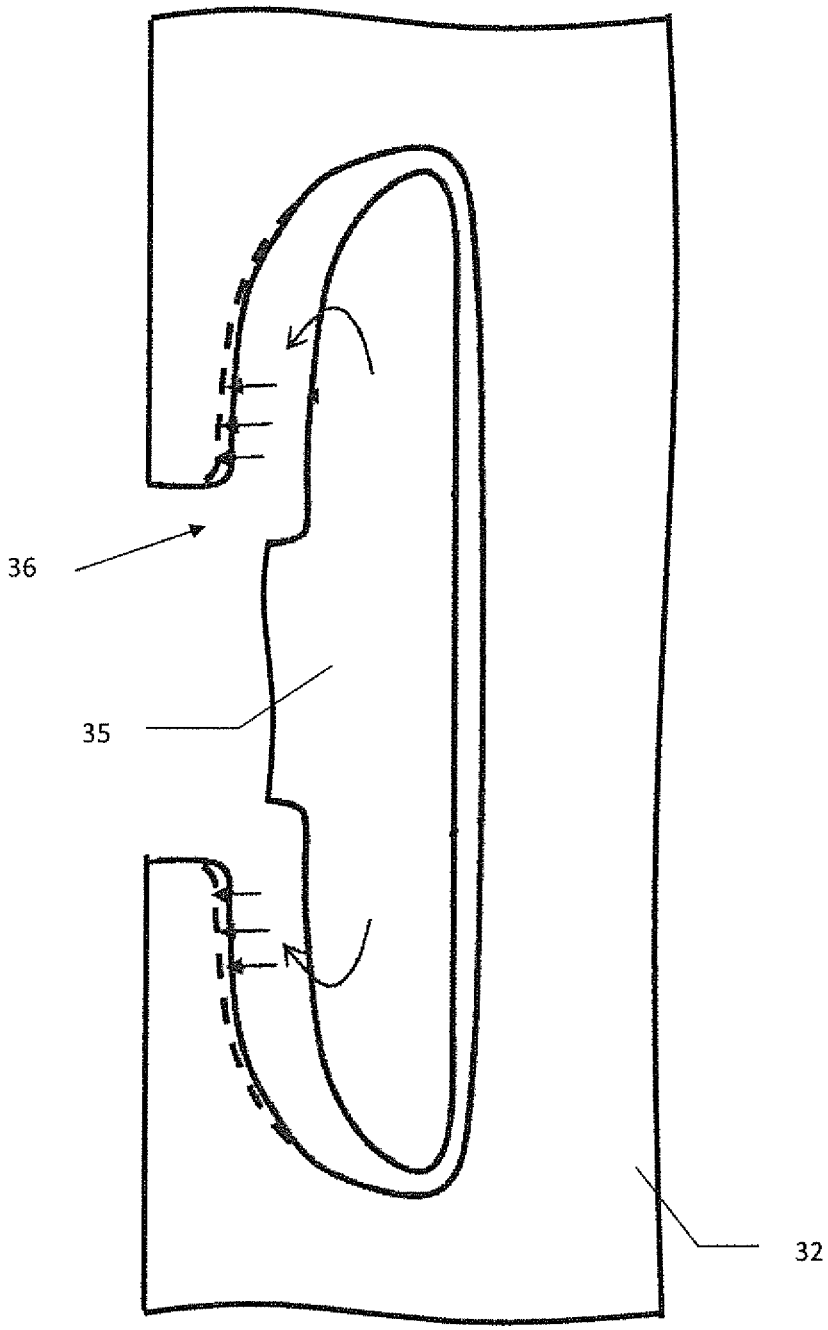
FIG. 2 is a top view of a male protrusion and corresponding female protrusion receptacle of the floor panel of FIG. 1 illustrating interconnection thereof.

Referring additionally to FIG. 2, desired horizontal locking may be achieved after the male protrusion 35 is inserted into a corresponding female protrusion receptacle 36 and then compressed into position. Portions of the female protrusion receptacles 36 (corresponding to the dotted lines shown in the FIG. 2) are slightly deflected due to the gradual progressive deviation of the curves of both the male protrusions 35 and the female protrusion receptacles with respect to each other. This deflection helps provide lateral locking for interconnected floor panels 30.

More particularly, the male protrusions 35 and corresponding female protrusion receptacles 36 have edges that come into contact when fully installed. The edges in contact have curvatures that may optionally generate gradual progressive compression forces that help provide horizontal (i.e., parallel to the exposed surface of the floor panel 30) locking or connection of the panels adjacent to one another.

Accordingly, using the floor panels 30, a locking system is provided in which flooring panels of various sizes, shapes, structures, and materials may be securely locked together. This may not only advantageously make both the manufacturing and the installation processes more efficient and cost effective, but it may also enable non-skilled individuals to install the panels 30 relatively easily and with the correct alignment.

More particularly, the installation of traditional flooring panels typically requires high levels of skill and is labor intensive. The manufacturing process for such panels may also be complicated. For example, elaborate quality control processes may be needed to ensure that the product is usable and consistent. However, the system and installation methods utilizing the floor panel 30 may significantly simplify both the installation and the manufacturing processes, therefore reducing the costs associated with each. Relatively simple tooling may be used to manufacture the panels, in some instances without machining, which allows for consistent and high quality panels to be manufactured. The floor panel 30 may be formed by mechanical machining, as well as through adhesion of the top layer 31 to the bottom layer 32.

Furthermore, as a result of the self-aligning and interlocking features provided by the male protrusions 35/female protrusion receptacles 36 and the male lips 37/female lip receptacles 38, installation of the panels by non-skilled individuals may be relatively easy and performed without training. The floor panel 30 when being installed is pulled closer to its neighbor by the locking mechanism described above. As such, when installed, the panels 30 are tightly held together, and the seams between the panels are less visible.

The floor panels 30 may be of different sizes, shapes, structures, and may be made of various materials such as plastics, wood, bamboo, etc. The male protrusions 35/female protrusion receptacles 36 from adjacent panels advantageously provide lateral connections when fit into or coupled with each other, while the coupling effect rendered by the male lips 37/female lip receptacles 38 will help prevent the panels from moving vertically with respect to one another. The male protrusions 35/female protrusion receptacles 36 and the male lips 37/female lip receptacles 38 may have different lengths and widths and take various sizes and shapes, which may be planar or non-planar, and may include arcs or curvatures, multiple arcs or curvatures, slants, and multiple slants.

That which is claimed is:

1. A floor panel to be positioned on a floor and comprising:
- a bottom layer and an upper layer overlying the bottom layer;
- wherein said bottom layer has first and second edges;
- wherein said bottom layer comprises at least one male protrusion on the first edge, and has at least one female protrusion receptacle on the second edge corresponding to a shape of said at least one male protrusion;
- wherein said bottom layer further comprises at least one male lip on the second edge, and has at least one female lip receptacle on the first edge corresponding to a shape of the at least one male lip;
- wherein said upper layer vertically overlies the at least one female lip receptacle and the at least one female protrusion receptacle so that the floor panel cannot be connected with an adjacent floor panel by pressing the floor panel down in a direction normal to the floor.

2. The floor panel of claim 1 wherein the shape of the at least one male protrusion is different than a shape of the at least one male lip.

3. The floor panel of claim 1 wherein the at least one male protrusion and the at least one male lip have different widths.

4. The floor panel of claim 1 wherein the at least one male protrusion and the at least one male lip have different lengths.

5. The floor panel of claim 1 wherein the at least one male protrusion is configured to compress corresponding sidewall portions of a corresponding female protrusion receptacle of an adjacent floor panel upon connection therewith.

6. The floor panel of claim 1 wherein said bottom layer has a thickness, and wherein a width of the at least one lip is less than or equal to one and one-half times the thickness of said bottom layer.

7. The floor panel of claim 1 wherein said bottom layer also has third and fourth edges which are perpendicular to the first and second edges; and wherein at least one interlocking end protrusion is carried on each of the third and fourth edges of each bottom layer.

8. The floor panel of claim 1 wherein said top layer comprises at least one of wood and plastic.

9. A floor panel system comprising:
- a plurality of floor panels to be positioned on a floor and each comprising a bottom layer and an upper layer overlying the bottom layer;
- wherein said bottom layer of each floor panel has first and second edges;
- wherein said bottom layer of each floor panel comprises at least one male protrusion on the first edge, and has at least one female protrusion receptacle on the second edge corresponding to a shape of said at least one male protrusion;

wherein said bottom layer of each floor panel further comprises at least one male lip on the second edge, and has at least one female lip receptacle on the first edge corresponding to a shape of the at least one male lip;

wherein said upper layer of each floor panel vertically overlies the at least one female lip receptacle and the at least one female protrusion receptacle so that the floor panel cannot be connected with an adjacent floor panel by pressing the floor panel down in a direction normal to the floor.

10. The floor panel system of claim 9 wherein the shape of the at least one male protrusion is different than a shape of the at least one male lip.

11. The floor panel system of claim 9 wherein the at least one male protrusion and the at least one male lip have different widths.

12. The floor panel system of claim 9 wherein the at least one male protrusion and the at least one male lip have different lengths.

13. The floor panel system of claim 9 wherein the at least one male protrusion is configured to compress corresponding sidewall portions of a corresponding female protrusion receptacle of an adjacent floor panel upon connection therewith.

14. The floor panel system of claim 9 wherein said bottom layer has a thickness, and wherein a width of the at least one lip is less than or equal to one and one-half times the thickness of said bottom layer.

15. The floor panel system of claim 9 wherein said bottom layer also has third and fourth edges which are perpendicular to the first and second edges; and wherein at least one interlocking end protrusion is carried on each of the third and fourth edges of each bottom layer.

16. The floor panel system of claim 9 wherein said top layer comprises at least one of wood and plastic.

17. A floor panel installation method comprising:

arranging a plurality of floor panels on a floor, each floor panel comprising a bottom layer and an upper layer overlying the bottom layer, wherein the bottom layer has first and second edges, wherein the bottom layer comprises at least one male protrusion on the first edge and has at least one female protrusion receptacle on the second edge corresponding to a shape of the at least one male protrusion, wherein the bottom layer further comprises at least one male lip on the second edge and has at least one female lip receptacle on the first edge corresponding to a shape of the at least one male lip, and wherein the upper layer vertically overlies the at least one female lip receptacle and the at least one female protrusion receptacle so that the floor panel cannot be connected with an adjacent floor panel by pressing the floor panel down in a direction normal to the floor; and coupling the floor panels together so that the male protrusions are coupled to corresponding female protrusion receptacles of adjacent floor panels, and the male lips are coupled to corresponding female lip receptacles of adjacent floor panels.

18. The method of claim 17 wherein the shape of the at least one male protrusion is different than a shape of the at least one male lip.

19. The method of claim 17 wherein the at least one male protrusion and the at least one male lip have different widths.

20. The method of claim 17 wherein the at least one male protrusion and the at least one male lip have different lengths.

21. The method of claim 17 wherein the at least one male protrusion is configured to compress corresponding sidewall portions of a corresponding female protrusion receptacle of an adjacent floor panel upon connection therewith.

22. The method of claim 17 wherein the bottom layer has a thickness, and wherein a width of the at least one lip is less than or equal to one and one-half times the thickness of the bottom layer.

23. The method of claim 17 wherein the bottom layer also has third and fourth edges which are perpendicular to the first and second edges; wherein at least one interlocking end protrusion is carried on each of the third and fourth edges of each bottom layer; and wherein coupling the floor panels together further comprises coupling the interlocking end protrusions of adjacent floor panels together.

24. The method of claim 17 wherein the top layer comprises at least one of wood and plastic.

* * * * *